United States Patent [19]

Burkhalter

[11] Patent Number: 5,050,331

[45] Date of Patent: Sep. 24, 1991

[54] CLEANING APPARATUS FOR A PISTOL

[76] Inventor: Randall W. Burkhalter, Rte. 1, Box 78, Blackwell, Okla. 74631

[21] Appl. No.: 631,280

[22] Filed: Dec. 20, 1990

[51] Int. Cl.[5] ..... F41A 29/00

[52] U.S. Cl. ..... 42/95

[58] Field of Search ..... 42/95; 15/104.16

[56] References Cited

U.S. PATENT DOCUMENTS 4,195,381 4/1980 Jurick, III ..... 15/104.2

4,726,137 2/1988 Zurek et al. ..... 42/95

*Primary Examiner*—Charles T. Jordan

*Attorney, Agent, or Firm*—William J. Miller

[57] ABSTRACT

A cleaning apparatus for a gun or pistol which cleaning apparatus has a base and a vise for securing the barrel of the gun in parallel relationship to the base. A cleaning rod is positioned axially with the barrel of the gun and slideably attached to a mounting which is affixed to the base. A stiffening rod is likewise slideably attached to the base through the same mounting used to support the cleaning rod. One end of the cleaning rod and the stiffening rod is coupled to a crank, so that rotation of the crank will move the cleaning rod into and out of the barrel of the pistol being cleaned. The vise used to support the pistol is rigidly secured to the base through either a slot or a rail. Apparatus is provided for varying the full stroke of the cleaning rod to accommodate various length barrels.

13 Claims, 1 Drawing Sheet

CLEANING APPARATUS FOR A PISTOL

BRIEF DESCRIPTION OF THE PRIOR ART

The best art discovered by applicant is Rudolf Zurek, Marcus Spoetzl and Leonard Pongratz U.S. Pat. No. 4,726,137 issued Feb. 23, 1988. This patent discloses an apparatus for clamping a cleaning support apparatus around a gun barrel with a bearing mount extending away from the end of the gun barrel. Movement apparatus is attached to this extension with the cleaning rod attached to the movement apparatus for movement into and out of the barrel. Apparatus is also provided for rotating the cleaning apparatus as it moves into the barrel. This apparatus would work quite satisfactory for large barreled guns where the rod 3, can be of a substantially large size; however, the cleaning apparatus would not accommodate a very small diameter rod, since the rod would bend when it is being forced into a pistol, for example.

BRIEF DESCRIPTION OF THE INVENTION

This gun cleaning apparatus is particularly adapted to small diameter guns such as pistols, where the cleaning rod is very flexible. The cleaning apparatus essentially comprises a base, a vise for securing the barrel of the pistol in parallel relationship to the base, a cleaning rod slideably attached through a mounting means to the base and axially aligned with the barrel. The end of the cleaning rod facing the barrel has cleaning apparatus attached to it. A cleaning rod stiffening apparatus is slideably mounted in the mounting as the cleaning rod and basically consists of a rod having a diameter sufficiently large to insure that the rod is rigid as compared to the cleaning rod. An attachment is provided between the end of the stiffening rod and the end of the cleaning rod so that pressure applied to the attachment means will move both rods simultaneously along the axis of the gun barrel. A crank apparatus is attached to the base with an arm attached between the crank and the attachment means. When the crank is turned, the rod will push the cleaning rod and the stiffening rod slideably along the mounting in a manner to force the cleaning rod into and out of the barrel of the pistol.

The vise can be attached to the base in several ways. First, a slot can be provided in the base, or in an attachment to the base, so that the vise can be forced into the slot securely holding the vise in a manner to clamp the gun barrel and maintain it axially aligned with the cleaning rod. A second method is to provide a "T" shaped rail which is attached along the base and aligned with the cleaning rod in a manner to clamp the vise on each side around the "T" shaped rail, securely holding the vise against upward or horizontal movement. A wing nut and bolt are provided to force the vise securely against the gun barrel, holding the gun barrel rigidly in position along with holding the vise against the "T" shaped rail or in the groove or slot attached to the base.

DETAILED DESCRIPTION OF THE INVENTION

Figure 1:
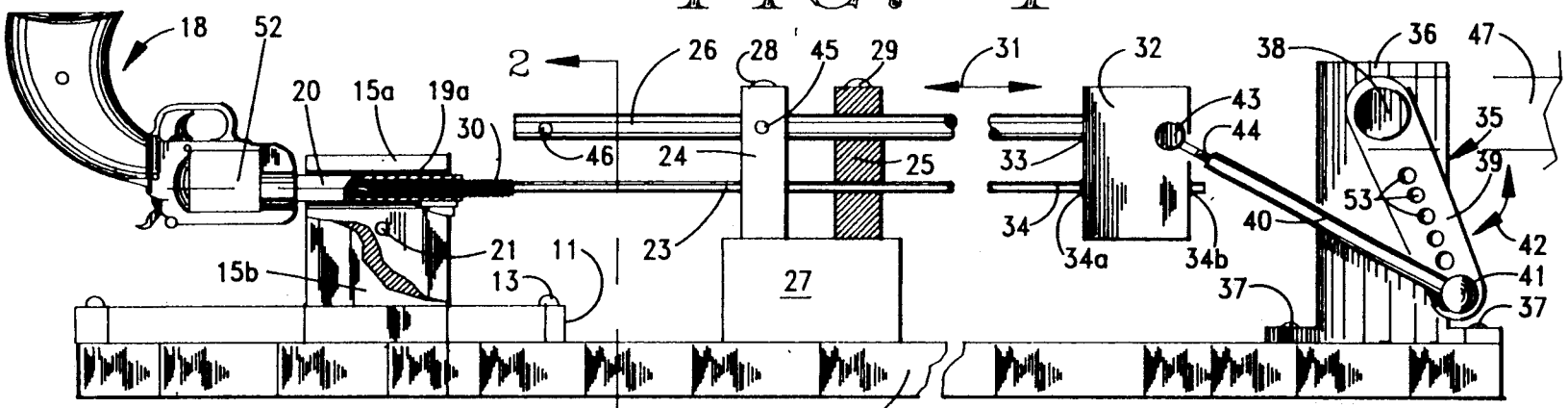
FIG. 1 is an overall schematic of the pistol cleaning apparatus.

Referring to all of the figures, but in particular to FIG. 1, a base 10 has an attachment apparatus 11 which can be attached to base 10 by a plurality of bolts 13 or any other usual way, such as glue. Attachment apparatus 11 contains a slot referred to generally by arrow 14, and is dimensioned to receive a pair of blocks 15-*a* and 15-*b*. In this regard, sidewalls 16 and 17 are spaced so that blocks 15-*a* and 15-*b* will fit snugly therebetween and provide a certain amount of alignment capability for the pistol referred to generally by arrow 18. Blocks 15-*a* and 15-*b* each has a groove 19-*a* and 19-*b* (see FIG. 3), for securing a barrel 20 of pistol 18. Grooves 19-*a* and 19-*b* are positioned to face each other for securely clamping barrel 20 therebetween. The barrel is then securely clamped by a bolt 21 and wing nut 22. A cleaning rod 23 is slideably journaled in a pair of upright members 24 and 25, 25 being shown in cross section to illustrate the mounting of cleaning rod 23 therein. Uprights 24 and 25 can be made of plastic or any suitable material for journaling cleaning rod 23 therein. A stiffening rod 26 is likewise slideably journaled in upright mountings 24 and 25 and parallelly spaced from cleaning rod 23 for the purpose of giving cleaning rod 23 capability of being pushed without bending.

Upright mountings 24 and 25 may extend to base 10 or may be mounted on a second mounting base 27, Mounting base 27 can be attached to base 10 by any usual method, such as screws, not illustrated. Upright mountings 24 and 25 may also be attached by screws 28 and 29 which pass vertically through mountings 24 and 25 respectively, and into mounting base 27. It is obvious that shims or any other material such as washers can be placed between upright mountings 24 and 25 and mounting base 27, in order to properly position cleaning rod 23 and stiffening rod 26.

Gun cleaning apparatus 30 is threadably attached in the usual manner to the end of cleaning rod 23. Such attachment and such apparatus is well known in the art and will not be further described. In order to move stiffening rod 26 and gun cleaning rod 23 in the direction of arrow 31, an attachment 32 is coupled between ends 33 of stiffening rod 26 and end 34 of cleaning rod 23. In order to accommodate the natural rotation of the cleaning rod caused by the rifling of pistol 18, end 34 of cleaning rod 23 is free to rotate in attachment 32. Clips 34*a* and 34*b* are positioned on each side of attachment 32 and around cleaning rod 23 in order to prevent cleaning rod 23 from sliding out of attachment 32. Such clips 34*a* and 34*b* are spring c-shaped clips that fit in peripheral slots around attachment 32.

In order to provide movement in the direction of arrow 31, a crank assembly, illustrated by arrow 35 is provided. Crank assembly 35 essentially comprises a housing 36 which is attached to base 10 by any usual manner such as bolts 37. Crank housing 36 has a bearing, not illustrated, with a shaft 38 mounted therethrough. Shaft 38 has a crank arm 39 attached at one end and an adjustable arm 40 mounted at the other end. Crank arm 39 also has a handle 41 attached at its end for the purpose of turning crank arm 39 in the direction of arrow 42 illustrating that the crank arm can be moved in either direction and still accomplish the movement of stiffening rod 26 and gun cleaning rod 23 in the directions of arrow 31. Adjustable arm 40 is pivotally attached at handle 41 at one end and attached through pivot 43 to attachment 32. A threadable adjustment portion 44 is incorporated into adjustable arm 40 for the purpose of adjusting the stroke position of cleaning rod 23.

A position locking pin 45 is illustrated as being mounted in upright mounting 24 and is adapted to move into hole 46 when stiffening rod 26 is fully retracted with the crank arm 39 in position illustrated by dotted lines 47. In the position of dotted lines 47, the weight of the crank arm and handle will tend to cause the crank arm to fall. Pin 45, when inserted into hole 46 will prevent the arm from falling and permit easy removal and insertion of vise blocks 15-*a* and 15-*b* which hold pistol 18 prior to or after the cleaning operation.

Figure 3:
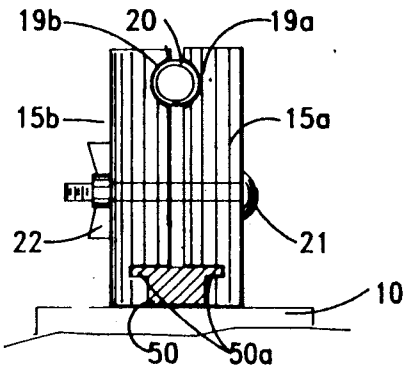
Figure 2:
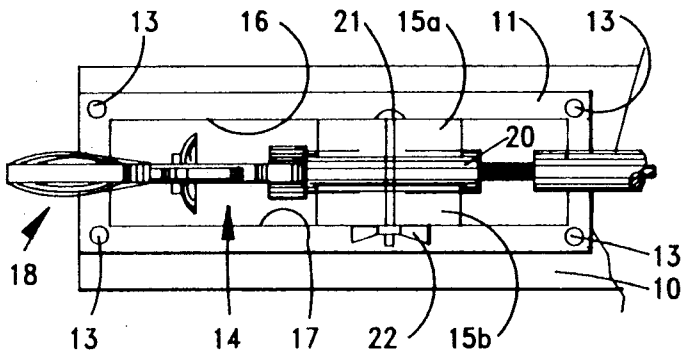
FIG. 2 is a top view taken through section lines 2—2 of FIG. 1; and, FIG. 3 is an end view of an alternate mounting for the pistol vise.

Referring to FIG. 3, an alternate method of attaching blocks 15-*a* and 15-*b* to base 10 is illustrated and essentially comprises a "T" shaped rail 50 which is attached to block 10 in any usual manner, such as screws. In this embodiment, barrel 20 is clamped into arcuate slots 19-*a* and 19-*b* by blocks 15-*a* and 15-*b* when bolt 21 is tightened by wing nut 22. The blocks are positioned on each side of rail 50 and wing nut 22 and simultaneously around barrel 20. Portions 50*a* prevent the blocks 15-*a* and 15-*b* from lifting up when pressure is applied to barrel 20 by cleaning element 30. With slots 19-*a* and 19*b* properly dimensioned, several size gun barrels 20 can be accommodated.

OPERATION

Referring to all of the figures, the operation of the gun cleaning apparatus will be described. Normally to begin the cleaning operation, crank handle 41 is forced upward in the direction of arrow 42 to the position of dotted lines 47. Pin 45 is then inserted into hole 46 so that gun cleaning rod 23 will be in the fully retracted position. A gun or pistol 18 is then inserted between blocks 15-*a* and 15-*b* into slots 19-*a* and 19-*b*. Wing nut 22 is then securely tightened, clamping blocks 15-*a* and 15-*b* tightly around barrel 20 of pistol 18. The tightened assembly comprising pistol 18, blocks 15-*a* and 15-*b* is then forced into groove 14 between faces 16 and 17 in a manner to axially align gun barrel 20 with cleaning rod 23. Pin 45 is then pulled out of engagement with hole 46 and crank 41 is then turned, causing rod 23 to reciprocate in the directions of arrow 31. The cleaning portion 30 attached to the end of rod 23 will move into and out of barrel 20.

The rod cleaning portion 30 is designed to move into barrel 20 as illustrated by dotted lines 52. In the case illustrated, the cylinder used to retain the bullets in pistol 18 has been removed so that the actual penetration of end 30 can be observed. It is desired not to force the end 30 into pistol 18 to a point where end 30 will strike the firing pin and damage same. It is important to observe the total penetration of end 30 into and through barrel 20. Adjustments can be made by changing the location of blocks 15-*a* and 15-*b* in slot 14 by moving the blocks forward or rearward, to or away from cleaning end 30.

When crank 41 is rotated, rod 23 moves as previously described, in the direction of arrow 31. Stiffening member 26 supplies support to rod 23 to prevent rod 23 from bending when pressure is applied to end 34 of rod 23. Since rod 23 is very small in diameter, it can easily bend when resistance is being applied by end 30 and force is being applied by end 34. Holes 53 provide additional adjustment for the total travel of cleaning rod 23 in the directions of arrow 31. Thus handle 41 can be unscrewed and adjustable arm 40 can be moved up in to one of various holes 53 in order to adjust the total length of travel of rod 23 thereby, accommodating long and short barrels 20 of pistol 18. Referring to FIG. 3, an alternate method of clamping blocks 15-*a* and 15-*b* is illustrated and uses a "T" shaped rail 50. The barrel 20 is placed in slots 19-*a* and 19-*b* and the assembly, including blocks 15-*a* and 15-*b* is thin positioned along rail 50. Wing nut 22 is then tightened around bolt 21 until the bottom portion of blocks 15-*a* and 15-*b* clamp securely against rail 50. The top of blocks 15-*a* and 15-*b* clamp securely around barrel 30 retained in slots 19-*a* and 19-*b*. It is obvious that the rail will provide ease of movement of the blocks 15-*a* and 15-*b* horizontally along base 10 and yet prevent upward movement of the blocks because of portions 50*a*.

CONCLUSION

It is obvious that other modifications can be made in this invention and still be well within the spirit and scope of this invention as described in the specification and appended claims.

What I claim is:

1. A cleaning apparatus for a gun having a barrel comprising:

(a) a base;
(b) a cleaning rod having a first and second end;
(c) vise means for securing the barrel of the gun in parallel relationship to said base;
(d) means for securing said vise means to said base;
(e) cleaning rod securing means attached to said base and slidably positioned in axial alignment with said barrel;
(f) cleaning rod stiffening means slidably mounted in said securing means;
(g) attachment means for securing said stiffening means and said first end of said cleaning rod; and,
(h) actuating means for moving said cleaning rod and said stiffening rod simultaneously along said axis of said gun barrel and by a distance at least as long as said gun barrel.

2. Apparatus as claimed in claim 1 wherein said actuating means comprises a crank means attached to said base, and arm means attached between said crank means and said attachment means.

3. Apparatus as claimed in claim 2 wherein said crank means includes means for adjusting the total travel distance of said arm means, whereby said total distance of movement of said cleaning rod can be varied to accommodate different barrel lengths.

4. Apparatus as claimed in claim 1 wherein said cleaning rod is rotatably attached to said cleaning rod securing means.

5. Apparatus as claimed in claim 3 wherein said means for adjusting the total travel distance of said arm means comprises a plurality of openings along said crank means, and means for attaching said arm means to one of said openings.

6. Apparatus as claimed in claim 1 wherein said vise means comprises a pair of blocks, each having a top and a bottom and facing surfaces, wherein each of said tops has a facing groove for securing said gun barrel formed parallel to said bottom, and slot means attached to said base for securing said blocks when said blocks are forced into said slot means.

7. Apparatus as claimed in claim 6 wherein said vise means includes bolt means passing through each of said block means and nut means for clamping said gun barrel in said facing grooves.

8. Apparatus as claimed in claim 1 wherein said means for securing said vise means to said base means comprises a vertical "T" shaped rail means attached to said base means.

9. A cleaning apparatus for a gun having a barrel comprising:

(a) an elongated base;

(b) vise means having a slot along its length including means for said gun barrel and positioning said gun barrel in parallel relationship to said base;

(c) means on said base for securing said vise means to said elongated base;

(d) a rod means having first and second ends with barrel cleaning apparatus on said second end;

(e) rod securing means for slidably securing said rod means to said elongated base and in axial alignment with said barrel;

(f) stiffening means for said rod means having an end;

(g) attachment means for securing said end of said stiffening means and said first end of said rod means;

(h) crank means including a housing attached to said elongated base, a bearing and shaft means mounted to said housing, a crank arm attached at one end to said shaft means and at its remaining end to a handle; and, (i) arm means coupling said crank arm to said attachment means; whereby said barrel cleaning apparatus can be moved in and out of said gun barrel secured in said vise means by rotating said crank means causing said rod means to slidably move along said securing means.

10. Apparatus as claimed in claim 9 wherein said crank arm includes a plurality of spaced openings for securing said arm means to vary the total distance said rod means slides in said attachment means.

11. Apparatus as claimed in claim 9 wherein said stiffening means comprises a rod slidably and parallelly spaced in said securing means with said rod means.

12. Apparatus as claimed in claim 9 wherein said vise means is secured to said elongated base by positioning said vise means into a slot in said elongated base.

13. Apparatus as claimed in claim 9 wherein said vise means is secured to said elongated base by clamping said vise means between a vertical rail means attached to said elongated base.

* * * * *